US006179699B1

(12) United States Patent
Costa

(10) Patent No.: US 6,179,699 B1
(45) Date of Patent: Jan. 30, 2001

(54) SHAPE MEMORY ALLOY-CONTROLLED SLURRY DISPENSE SYSTEM FOR CMP PROCESSING

(75) Inventor: Matthew B. Costa, Austin, TX (US)

(73) Assignee: Advanced Micro Devices, Inc., Sunnyvale, CA (US)

( * ) Notice: Under 35 U.S.C. 154(b), the term of this patent shall be extended for 0 days.

(21) Appl. No.: 09/406,312

(22) Filed: Sep. 27, 1999

(51) Int. Cl.[7] ..... B24B 57/00
(52) U.S. Cl. ..... 451/446; 451/288
(58) Field of Search ..... 451/41, 60, 72, 451/36, 28, 288, 450, 446; 239/225.1, 229, 238, 245, 247; 29/447

(56) References Cited

U.S. PATENT DOCUMENTS

| | | | | |
|---|---|---|---|---|
| 5,836,066 | * | 11/1998 | Ingram | 29/90.7 |
| 5,921,849 | * | 7/1999 | Kim et al. | 451/60 |
| 6,048,256 | * | 4/2000 | Obeng et al. | 451/60 |
| 6,059,920 | * | 5/2000 | Nojo et al | 156/345 |

OTHER PUBLICATIONS

Stanley Wolf and Richard N. Tauber; *Silicon Processing for the VLSI Era; vol. 2: Process Integration*; pp. 238–239; 1990.
Shape Memory Applications, Inc.; *NiTi Smart Sheet No. 4—Two–Way Memory*; pp. 1–2; Mar. 25, 1998.
Shape Memory Applications, Inc.; *NiTi Smart Sheet No. 8—NiTi Actuator Wire Properties*; pp. 1–2; Mar. 25, 1998.
Shape Memory Applications, Inc.; *NiTi Smart Sheet No. 3—Selected Properties of NiTi*; pp. 1–2; Mar. 25, 1998.
Shape Memory Applications, Inc.; *NiTi Smart Sheet No. 13—Specifying NiTi Materials*; pp. 1–6; May 1, 1998.
Dynalloy, Inc.; *Flexinol*™; pp. 1–2; Dec. 1998.

* cited by examiner

*Primary Examiner*—Timothy V. Eley
*Assistant Examiner*—Dung Van Nguyen
(74) *Attorney, Agent, or Firm*—Timothy M. Honeycutt

(57) ABSTRACT

Various apparatus for CMP processing of workpieces are provided. In one aspect, a CMP tool is provided that includes a polish pad for polishing a workpiece and a head assembly for holding the workpiece during polishing. A fluid dispenser is also provided for dispensing a fluid to process the workpiece. The fluid dispenser has a housing and a tube coupled to the housing for dispensing a semiconductor processing fluid. The tube has a first end that is operable to move from a first elevation to a second elevation. A first shape memory member is provided that has a first end coupled to the housing and a second end coupled to the tube. The shape memory member is operable to deform in response to a thermal stimulation to selectively move the tube from the first elevation to the second elevation. The tool provides selective dispersal of processing fluids on a CMP polish pad or other processing surface is before, during and after CMP or other processes. The shape memory member actuator is simple in design and capable of hundreds of thousands or even millions of cycles. Slurry stagnation at pad edge is avoided since reliance on centrifligal force for horizontal fluid movement is reduced. Savings may be realized in both prewet time and slurry consumption.

39 Claims, 6 Drawing Sheets

FIG. 6
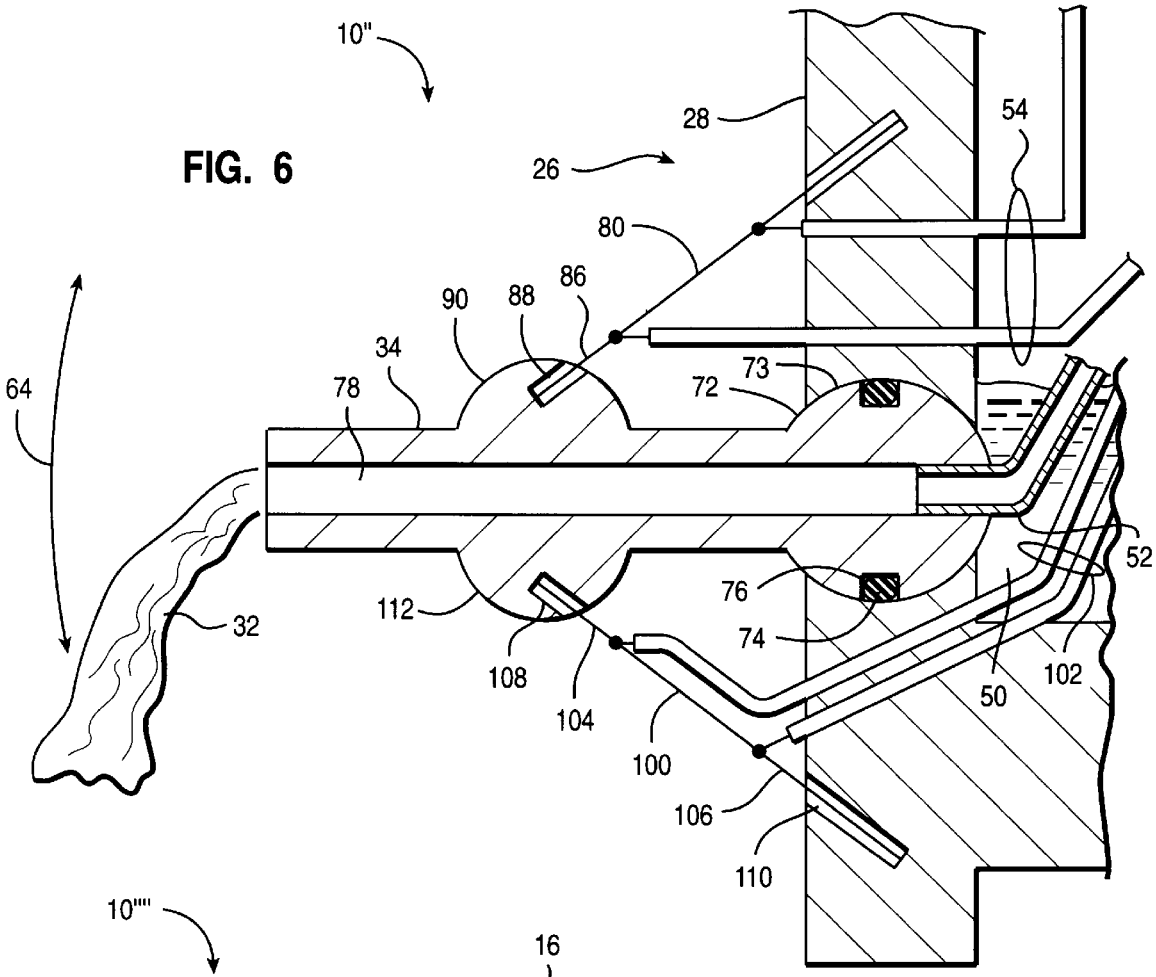
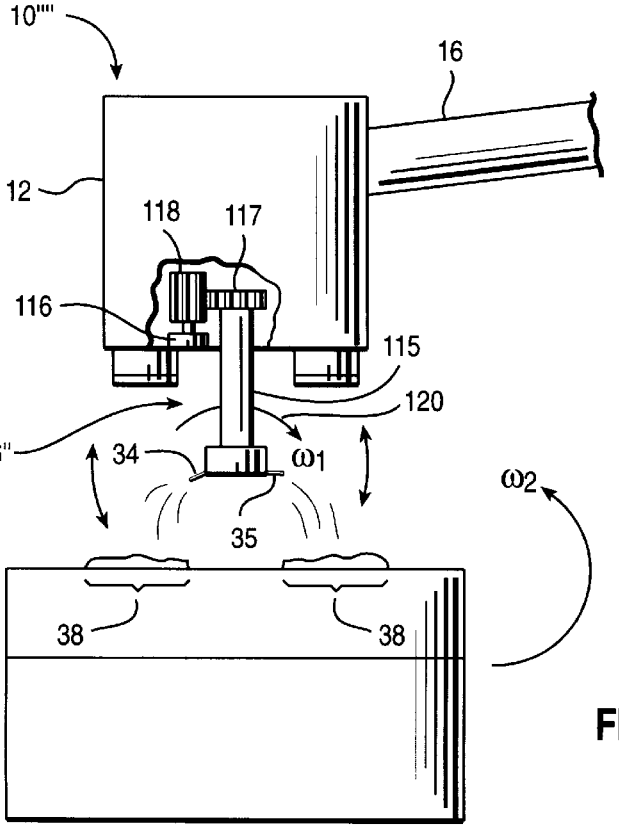
FIG. 8

FIG. 9
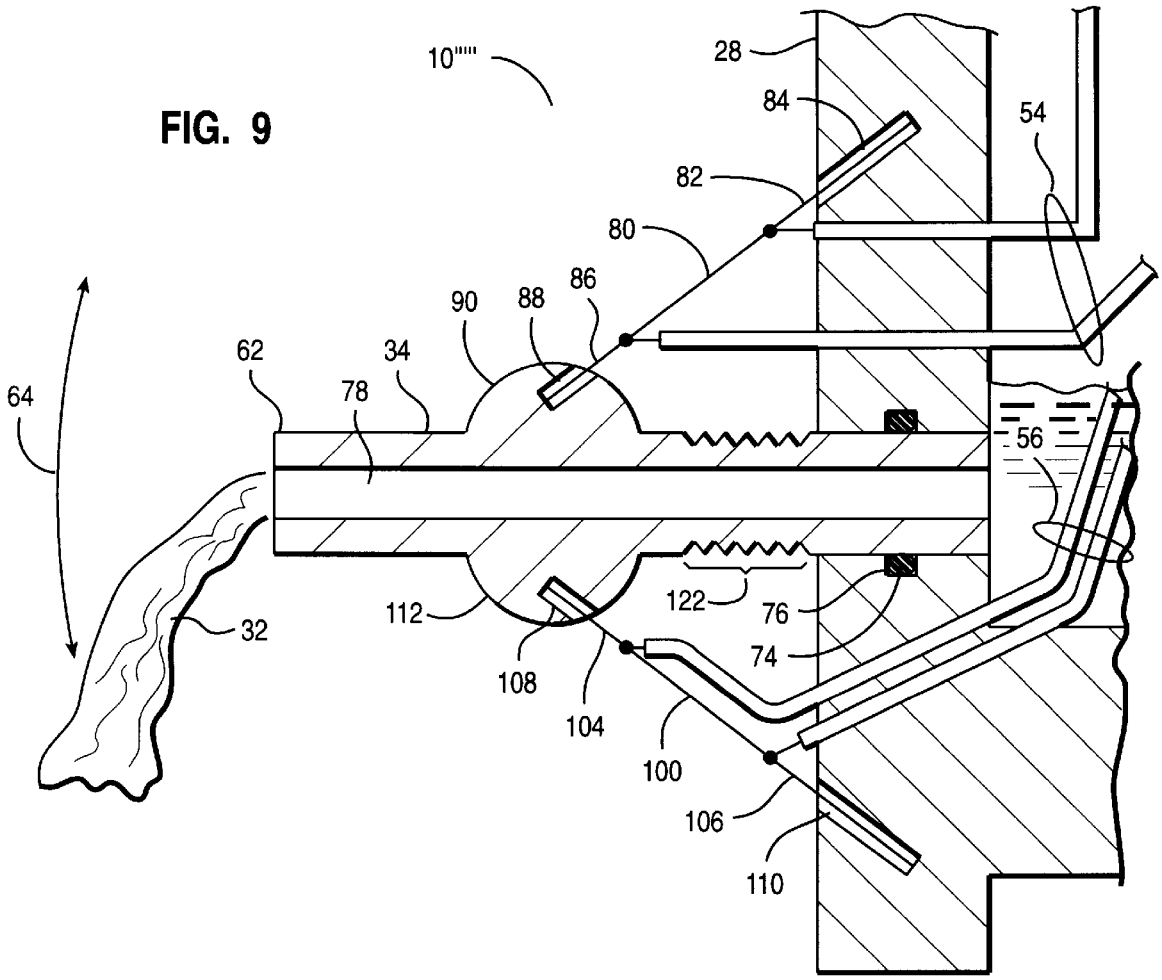
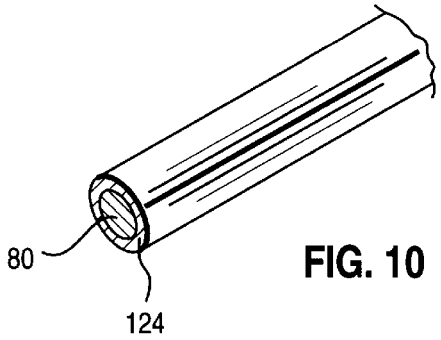
FIG. 10
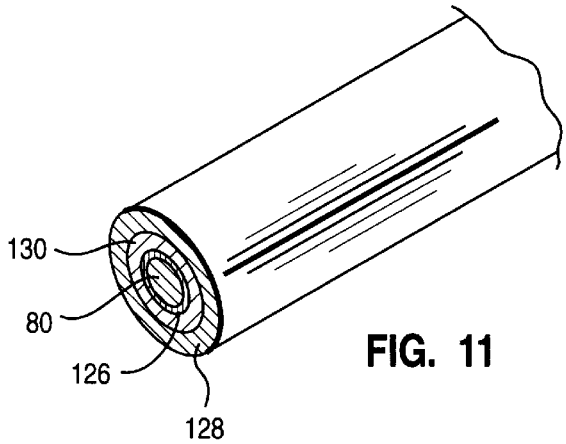
FIG. 11

SHAPE MEMORY ALLOY-CONTROLLED SLURRY DISPENSE SYSTEM FOR CMP PROCESSING

BACKGROUND OF THE INVENTION

1. Field of the Invention

This invention relates generally to semiconductor fabrication, and more particularly to a CMP system and a processing fluid dispensing system therefore.

2. Description of the Related Art

Conventional chemical mechanical planarization ("CMP") processes involve the planarization of a surface of a wafer or workpiece through the use of an abrasive slurry and various rinses and solvents. Material removal from the workpiece surface is through a combination of abrasive action and chemical reaction. In many processes, a quantity of abrasive slurry is introduced onto a polish pad of the CMP tool and distributed across the surface thereof by means of centrifugal force. Thereafter, one or more wafers are brought into sliding contact with the polish pad for a select period of time.

In many conventional CMP systems, processing fluids such as slurries, solvents and rinses are dispensed from a static dispense tube that is centrally positioned above the polish pad. The polish pad is fitted with an upwardly projecting dispersal cone that is designed to disperse processing fluid dispensed from above laterally across the polishing surface of the polish pad. The action of the fluid flowing down the sloped surfaces of the dispersal cone along with centrifugal force associated with the rotation of the polish pad is intended to provide a fairly uniform layer of processing fluid across the surface of the polish pad.

The planarity of a surface following CMP processing is dependent upon a variety of factors, such as the initial uniformity of the slurry prior to CMP, the uniformity of the slurry dispensed on a polish pad prior to wafer landing and during processing, and the uniformity in force applied to the wafer, among others. The initial uniformity of the slurry is dependent on quality control by the slurry manufacturer and upon proper handling prior to CMP processing. Uniform force application depends on the functioning of the wafer handling elements of the CMP tool, the condition of the polish pad and the density of the underlying slurry. Slurry uniformity after dispersal depends several factors. One significant factor is the method of fluid delivery employed by the CMP tool.

There are several disadvantages associated with conventional CMP tool fluid delivery systems. Reliance upon centrifugal force as the primary mechanism for dispersal of slurry across the polish pad surface can lead to slurry stagnation at the outer edge of the polish pad. Slurry stagnation near the outer edge of a polish pad is also a result of a combination of other mechanisms, such as the gradual dilution of the slurry due to the radially outward flow of waste products removed from the wafer surface during polishing, and the lack of an adequate real time refreshing of slurry onto the polish pad from the fluid dispensing system. Accordingly, in areas of the polish pad where slurry stagnation is occurring, there will be less reactants, and thus less than optimal polishing for those portions of wafer surfaces that are polished by that portion of the polish pad.

Time and slurry consumption are two other disadvantages associated with conventional CMP systems. For both oxide and metal CMP processes conducted on various conventional CMP tools, a polish pad pre-wet segment must be performed prior to wafer landing. The pre-wet segment may last about 30 seconds and consume about 500 ml of slurry/polish run. This cycle time and slurry consumption is a necessary though undesirable consequence of the use of a pump fed fluid delivery system in conjunction with the aforementioned dispersal cone and polish pad rotation to provide centrifugal force dispersal of the fluid across the polish pad.

The present invention is directed to overcoming or reducing the effects of one or more of the foregoing disadvantages.

SUMMARY OF THE INVENTION

In accordance with one aspect of the present invention, a semiconductor processing fluid dispenser is provided that includes a housing and a tube coupled to the housing for dispensing a semiconductor processing fluid. The tube has a first end that is operable to move from a first elevation to a second elevation. A first shape memory member is provided that has a first end coupled to the housing and a second end coupled to the tube. The shape memory member is operable to deform in response to a thermal stimulation to selectively move the tube from the first elevation to the second elevation.

In accordance with another aspect of the present invention, a CMP tool is provided that includes a polish pad for polishing a workpiece and a head assembly for holding the workpiece during polishing. A fluid dispenser is also provided for dispensing a fluid to process the workpiece. The fluid dispenser has a housing and a tube coupled to the housing for dispensing a semiconductor processing fluid. The tube has a first end that is operable to move from a first elevation to a second elevation. A first shape memory member is provided that has a first end coupled to the housing and a second end coupled to the tube. The shape memory member is operable to deform in response to a thermal stimulation to selectively move the tube from the first elevation to the second elevation.

In accordance with another aspect of the present invention, a CMP tool is provided that includes a polish pad for polishing a workpiece and a head assembly for holding the workpiece during polishing. A fluid dispenser is also provided for dispensing a fluid to process the workpiece. The fluid dispenser has a housing and a tube coupled to the housing for dispensing a semiconductor processing fluid. The tube has a first end and a second end pivotally coupled to the housing so that the first end is operable to move from a first elevation to a second elevation. A first shape memory member is provided that has a first end coupled to the housing and a second end coupled to the tube. The shape memory member is operable to deform in response to a thermal stimulation to selectively move the first end of the tube from the first elevation to the second elevation. Means for thermally stimulating the first shape memory member is included along with a biasing member to bias the first end of the tube toward the first elevation.

BRIEF DESCRIPTION OF THE DRAWINGS

The foregoing and other advantages of the invention will become apparent upon reading the following detailed description and upon reference to the drawings in which:

FIG. 6 is a sectional view like FIG. 5 of an alternate exemplary embodiment of the CMP tool in accordance with the present invention;

FIG. 8 is a side view like FIG. 7 of another alternate exemplary embodiment of the CMP tool in accordance with the present invention;

FIG. 9 is a sectional view like FIG. 6 of another alternate exemplary embodiment of the CMP tool in accordance with the present invention;

FIG. 10 is a magnified pictorial view of a portion of the shape memory member with a portion thereof shown in section in accordance with the present invention; and FIG. 11 is a pictorial view like FIG. 10 of an alternate exemplary embodiment of the shape memory member in accordance with the present invention.

DETAILED DESCRIPTION OF SPECIFIC EMBODIMENTS

Figure 1:
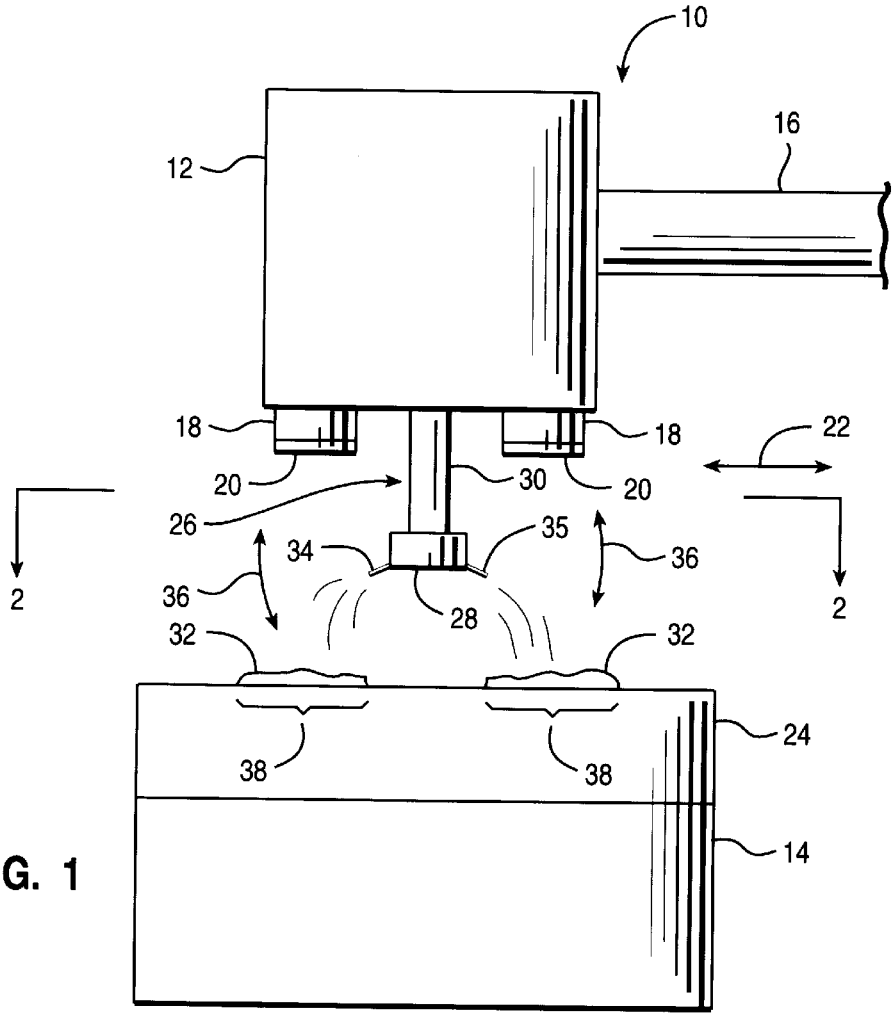
FIG. 1 is a side view of an exemplary embodiment of a chemical mechanical planarization ("CMP") tool in accordance with the present invention.
Figure 2:
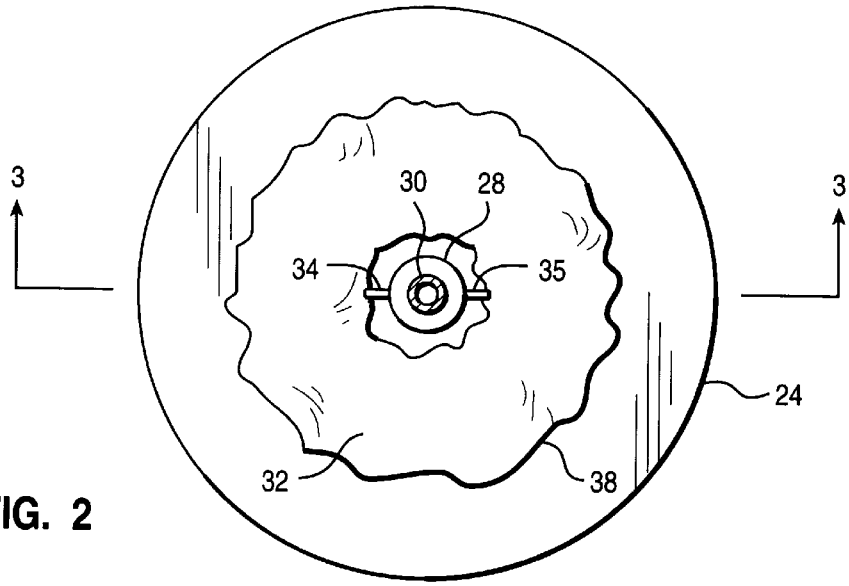
FIG. 2 is a sectional view of FIG. 1 taken at section 2—2 in accordance with the present invention.

In the drawings described below, reference numerals are generally repeated where identical elements appear in more than one figure. Turning now to the drawings, FIGS. 1 and 2 illustrate, respectively, a side view and a sectional view of an exemplary embodiment of a chemical mechanical planarization ("CMP") tool 10 in accordance with the present invention. FIG. 2 is a sectional view of FIG. 1 taken at section 2—2. The CMP tool 10 includes a head assembly 12 that is positioned above a table assembly 14. The head assembly 12 is movable vertically by way of a support member 16 that is coupled thereto. The support member 16 may be operated electrically, mechanically or by fluid drive. The depiction of the support member 16 is intended to be schematic in nature as a myriad of structures may be used to support and move the head assembly 12 vertically. The head assembly 12 is provided with one or more heads 18 which are designed to manipulate semiconductor workpieces 20. The heads 18 are operable to rotate the workpieces 20 and to oscillate radially, that is, in a plane parallel to the plane given by the arrow 22 during CMP processing. The heads 18 may employ a variety of mechanisms to grasp the workpieces 20, such as, for example, vacuum suction, mechanical clamping or the like. The workpieces 20 may be semiconductor wafers or some other type of semiconductor processing workpiece.

The dispensing of semiconductor processing fluids from the head assembly 12 onto a circular polish pad 24 of the table assembly 14 is provided by a fluid dispenser 26 that is coupled to the head assembly 12. The fluid dispenser 26 includes a housing 28 that is coupled to the head assembly 12 by a shaft 30. Fluid 32 is dispensed from the fluid dispenser 26 onto the polish pad 24 by two tubes 34 and 35. The fluid 32 may be a slurry, a rinse, a solvent or other type of processing fluid. As described more fully below, the tubes 34 and 35 are selectively movable vertically as indicated by the angular arrows 36 so that the fluid 32 may be dispensed across an annular surface area 38 of the polish pad 24 as shown. Two tubes 34 and 35 are depicted. However, the skilled artisan will appreciate that the number and spacing of the dispensing tubes, such as the tubes 34 and 35, is largely a matter of design discretion.

Figure 3:
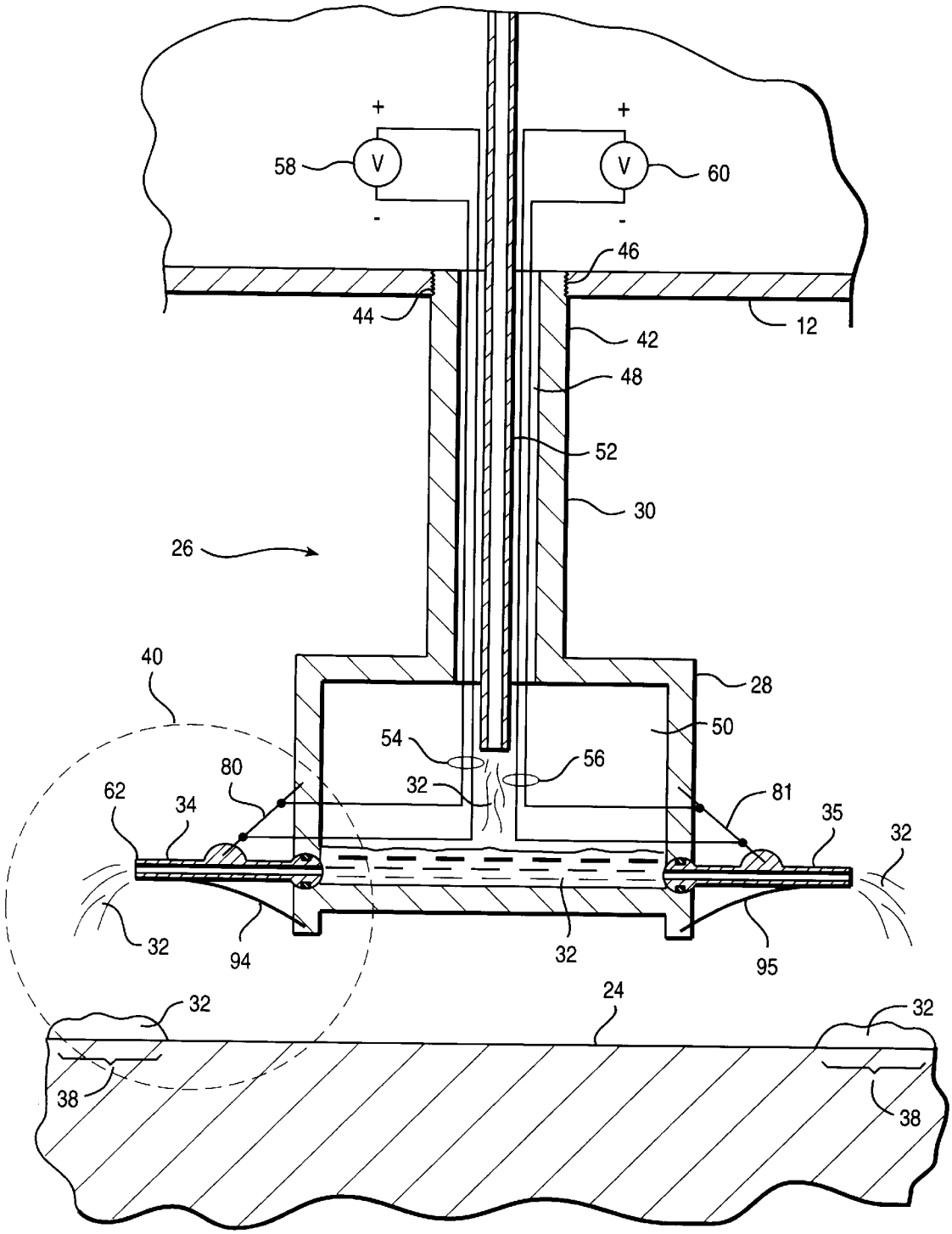
FIG. 3 is a sectional view of FIG. 2 taken at section 3—3 in accordance with the present invention.
Figure 4:
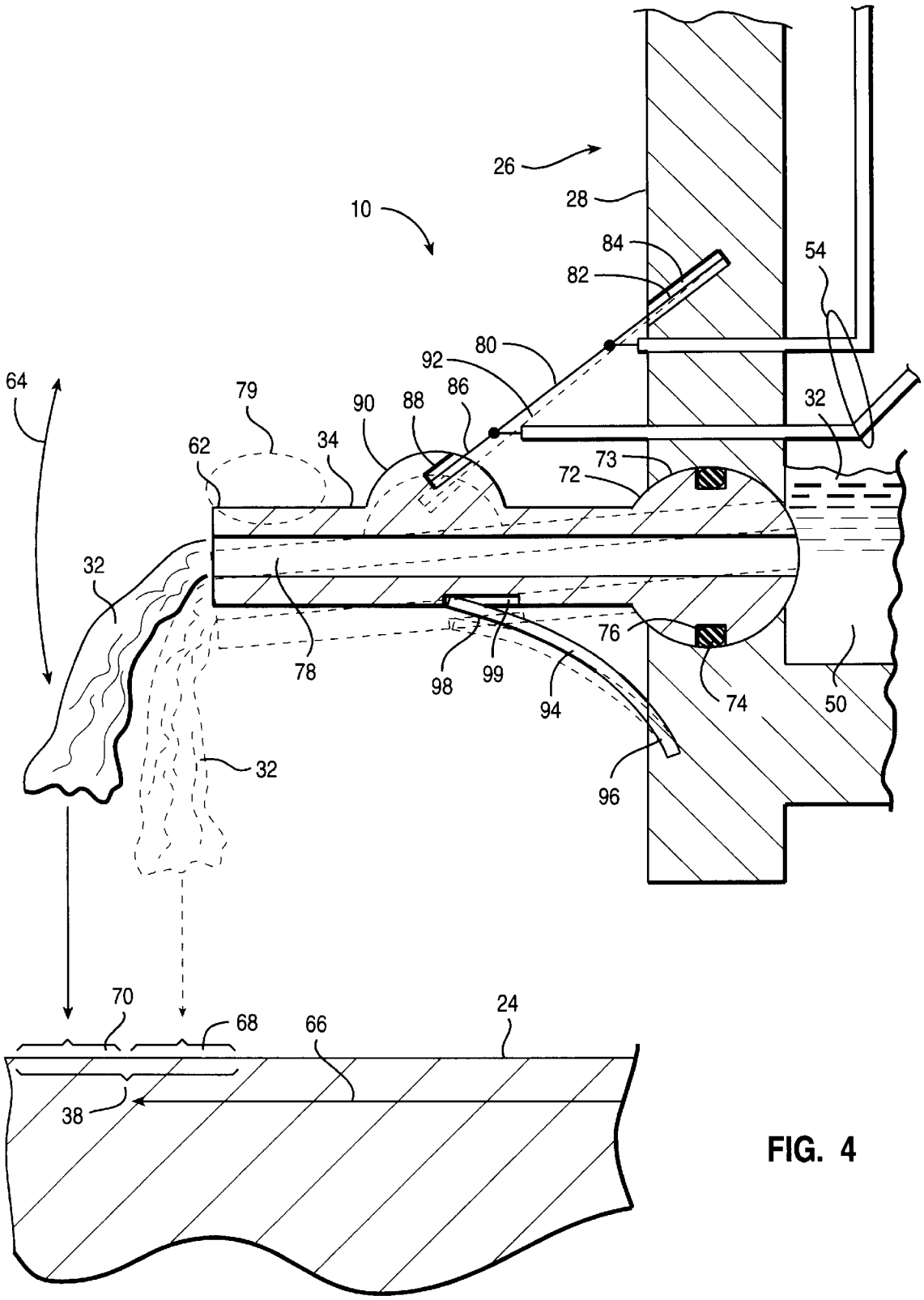
FIG. 4 is a magnified view of a designated portion of FIG. 3 in accordance with the present invention.

The detailed structure of the fluid dispenser 26 may be understood by referring now to FIGS. 3 and 4. FIG. 3 is a cross sectional view of FIG. 2 taken at section 3—3, and FIG. 4 is a magnified portion of FIG. 3 that is circumscribed generally by the dashed circle 40. Note that a lower portion of the head assembly 12 is depicted for clarity of illustration. The upper end 42 of the shaft 30 is positioned in a bore 44 in the head assembly 12 and threadedly engaged at 46. The shaft 30 is a tubular member with a lumen 48 that opens into an internal cavity 50 of the housing 28. The shaft 30 may be integrally formed with, threadedly or otherwise engaged to the housing 28. The lumen 48 is advantageously provided to accommodate a fluid supply line 52 that delivers a supply of the semiconductor processing fluid 32 from the head assembly 12 into the internal cavity 50. In addition, the lumen 48 accommodates respective pairs of conductors 54 and 56 which are connected to respective voltage sources 58 and 60. The voltage sources 58 and 60 may be DC or AC. The function of the conductors 54 and 56 and the voltage sources 58 and 60 will be detailed below.

The following description of the structure and function of the tube 34 is also illustrative of the tube 35. The tube 34 is configured so that one end 62 thereof is operable to move from a first elevation to a second elevation (shown in phantom) and vice versa. This vertical movement of the end 62 of the tube 34 results in the end 62 moving through an arc indicated schematically by the curved arrow 64. The arcuate movement of the end 62 enables the tube 34 to be selectively moved to dispense the fluid 32 at different points along a radius 66 of the polish pad 24 as illustrated by the fluid 32 falling onto two different areas 68 and 70. In this way, fluid 32 may be relatively uniformly dispersed across the entire annular area 38 of the polish pad 24. If the fluid 32 is dispensed while the tube 34 is moved, the fluid 32 will impact not only the areas 68 and 70, but also the annular area between the areas 68 and 70.

Vertical movement of the tube 34 is facilitated by coupling the tube 34 to the housing 28 using a ball and socket joint. The end 72 of the tube 34 is provided with a circular cross-section as shown. The housing 26 is provided with a mating bore 73 with a circular cross-section to define the ball and socket joint and to enable the end 72 to readily pivot therein. The joint between the end 72 and the housing 28 is sealed against fluid passage by an O-ring 74 that is positioned in an annular slot 76 formed in the end 72.

The tube 34 is provided with a lumen 78 that is in fluid communication at the end 72 with the internal cavity 50 to enable the fluid 32 to flow from the cavity 50 through the lumen and onto the polish pad 24. If desired, an upper portion of the tube 34, such as the portion circumscribed generally by the dashed oval 79, may be eliminated so that the tube 34 is configured as a trough.

The shaft 30, housing 28 and tubes 34 and 35 are advantageously composed of light weight materials that are resistant to chemical attack by the various CMP processing fluids passing therethrough. Exemplary materials include, for example, PTFE (fluoropolymer resin), Teflon® based materials, or the like.

To selectively move the tubes 34 and 35, shape memory members 80 and 81 are respectively coupled to the housing 28 and the tubes 34 and 35. The following description of the structure and function of the shape memory member 80 is illustrative of the structure and function of the shape memory member 81. One end 82 of the shape memory member 80 is positioned in a bore 84 in the housing 26 and the other end 86 is positioned in a bore 88 that created in a boss 90 formed on the tube 34. The shape memory member 80 is designed to deform in response to thermal stimulation to selectively move the end 62 of the tube 34 from a first elevation to a second elevation. In the illustrated embodiment, the shape memory member 80 is operable to elongate in response to thermal stimulation to facilitate the desired movement of the tube 34. The thermal stimulation of the shape memory member 80 is provided by passing a current therethrough via the pair of conductors 54 and the voltage source 58 (See FIG. 1). The position of the shape memory member 80 following deformation is illustrated by the dashed line 92. Note that the shape memory member 80 will sweep through a small arc during deformation. The skilled artisan will appreciate that it is desirable to prevent the shape memory member 80 from binding against the walls of the respective bores 84 and 88 as the shape memory member 80 sweeps through an arc. Accordingly, the bores 88 and 90 should be sized to enable the ends 86 and 82 of the shape memory member 80 to have sufficient freedom of movement to avoid binding during elongation.

A biasing member 94 is provided to bias the tube 34 toward the position shown in FIG. 4. A substantially identical biasing member 95 is provided for the tube 35 as shown in FIG. 3. The following description of the structure and function of the biasing member 94 is illustrative of the structure and function of the biasing member 95. The biasing member 94 is coupled at one end 96 to the housing 28 and rests at its other end 98 in a slot 99 formed in the surface of the tube 34. The slot 99 is designed to provide a relatively flat surface for the end 98 to bear against. When the shape memory member 80 is thermally stimulated and elongates, the biasing member 94 is deflected to the lower position indicated by the phantom figure. When the electrical current flow to the shape memory member 80 is cut off, thermal stimulation thereto is eliminated and the biasing member 94 moves the tube 34 back to the original position depicted in FIG. 4. In the illustrated embodiment, the biasing member 94 is a curved leaf spring. However, the type and configuration of the biasing member 94 is largely a matter of design discretion. For example, a coil spring, an elastomeric member of other type of spring member may be used.

The shape memory member 80 is advantageously composed of shape memory alloy material that may have one-way or two-way memory. Shape memory materials exhibit the ability to recover a trained shape upon heating above their transformation temperatures. The materials may be initially provided with a trained shape and thereafter heated above their transformation temperatures and reformed to a temporary shape. Thereafter, when the materials are heated above their transformation temperatures, they recover to the initial trained shape. If the material exhibits two-way memory and is allowed to cool below the transformation temperature, the material may recover to the temporary shape. In the embodiment illustrated in FIGS. 1–4, the shape memory member 80 exhibits one-way memory and is fabricated with a trained shape that is illustrated by the elongated condition of the dashed line 92. After being provided with the initial trained shape, the shape memory member 80 is provided with a temporary shape that is illustrated by the solid line 80 in FIG. 4. Thereafter, when the shape memory member 80 is thermally stimulated, that is, heated above its transformation temperature, the shape memory member 80 recovers to the trained shape illustrated by the dashed line 92. This elongation of the shape memory member 80 provides the aforementioned movement of the tube 34.

A variety of shape memory materials may be used for the shape memory member 80, such as, for example, various nickel titanium ("NiTi") alloys or the like. Heating above the transformation temperature for the NiTi alloy causes the alloy to undergo a phase change from martensite to austenite. In an exemplary embodiment, the NiTi alloy may have an active austenite finish temperature or Active $A_f$, of about 95–115° C. and a composition of less than about 55 weight percent nickel and the balance titanium, where the Active $A_f$ has a tolerance of about ±3 to 5° C. The transformation temperature of a NiTi material does change during processing, such that the Active $A_f$ will most likely be different than the transformation temperature of the original ingot from which the shape memory member 80 is fabricated.

The phase transformation of the NiTi alloy occurs over a range of temperatures, where the Active $A_f$ represents the finish of the transformation from martensite to austenite upon heating. The start of the transformation upon heating is given by the transformation start temperature or $A_s$, and is about 15 to 20° C. lower than the Active $A_f$. Corresponding starting and finishing temperatures for the transformation from austenite back to martensite during cooling are designated transformation start temperature, or $M_s$, and transformation finish temperature, or $M_f$, respectively. The finish transformation temperature $M_f$ is about 15 to 20° C. lower than the start transformation temperature $M_s$. There is a hysteresis associated with the transformation. In this regard, the transformation to martensite upon cooling occurs at a temperature below the temperature at which the martensite reverts to austenite upon heating. For binary alloys, such as NiTi, the difference between $M_p$ and $A_p$ is about 25 to 50° C.

The shape memory member 80 may be formed as a wire, a ribbon or other configuration, and is subjected to a series of hot and cold working processes with annealing cycles that are conducted between the cold working steps. Following cold working, the shape memory material undergoes a heat treatment to bring out the shape memory properties and to achieve a proper balance of final mechanical properties. The trained shape is set into the material during this heat treatment. In the illustrated embodiment utilizing a straight wire for the shape memory member 80, the material is advantageously straight annealed. If composed of NiTi alloy, the shape memory member 80 may be used with a native oxide surface or may be provided with a bright silver surface which has been mechanically stripped of visible oxide.

As noted above, the shape memory member 80 may be provided with two-way memory so that the member 80 may be configured to recover to a preset or trained shape upon heating above its transformation temperature and then return to an alternate shape upon cooling. This two-way memory can provide movement and thus impart forces in two directions, but generally provides less recoverable strain than one-way shape memory materials. In an exemplary embodiment incorporating a NiTi alloy, the shape memory member 80 may be supplied with two-way memory by a variety of different approaches, such as, for example, over deformation while in the martensitic condition, shape memory cycling via a repeated cooling, deformation and heating process, pseudo elastic cycling via a repeated loading and unloading process, combined shape memory and pseudo elastic cycling, constrained temperature cycling of deformed martensite or the like. If two-way memory is imposed, care should be taken to avoid erasing the memory characteristics of the material due to overheating.

The amplitude and rate of deformation of the shape memory member 80 are related to the diameter thereof, and the level and duration of electrical current input from the voltage source 58. For example, NiTi members with diameters of about 0.001 inches to about 0.015 inches exhibit about a 6 to 8% elongation and about a 1 to 2 second deformation time with currents of about 20 mA to 2750 mA. The recovery time, or time required between heating cycles, is about 0.1 to 13 seconds for the aforementioned diameter range.

The desired sizing of the member 80 may be determined by considering the forces exerted on the tube 34 and the desired response time for the member 80. These forces are primarily functions of the length and weight of the tube 34, the flow rate and density of the fluid 32, and any frictional forces acting on the tube 34 during movement.

The operation of the embodiment of the CMP tool 10 illustrated in FIGS. 1–4 may be understood by referring now to FIGS. 1, 3 and 4. Initially, one or more wafers 20 are engaged by the head assembly 12. The voltage sources 58 and 60 are initially turned off, the tubes 34 and 35 are in the positions shown in FIGS. 3 and 4, and no fluid 32 is flowing into the housing 28. The voltage sources 58 and 60 are then activated to enable current to pass through the shape memory members 80 and 81. The shape memory members 80 and 81 elongate to the trained shapes (represented for the shape memory member 80 by the dashed line 92 in FIG. 4), propelling the tubes 34 and 35 downward. Fluid 32 is then discharged from the supply line 52 into the cavity 50 and flows out of the tubes 34 and 35. The fluid 32 flowing out of the tube 34 impacts the landing area 68 and the fluid flowing out of the tube 35 impacts an oppositely positioned landing area. Current flow to the shape memory members 80 and 81 is cutoff, enabling the biasing members 94 and 95 to move the tubes 34 and 35 upward. As the tubes 34 and 35 move upward, the impact points of the fluid 32 hitting the pad 24 move radially outward. If the pad 24 is rotated while the fluid 32 is flowing, the entire annular area 38 will be quickly covered.

If desired, the foregoing sequence of events may be rearranged. For example, fluid flow may be commenced before the shape memory members 80 and 81 are stimulated and continued until they move the tubes 34 and 35, resulting in a radially inwardly cascading dispersal.

Slurry stagnation at the outer edge of the pad 24 may be avoided by repeatedly dispensing the fluid 32 and cycling the tubes 34 and 35 during polishing. Time and slurry consumption during prewet are reduced in view of the enhanced and selective management of fluid dispersal across the pad 24.

Figure 5:
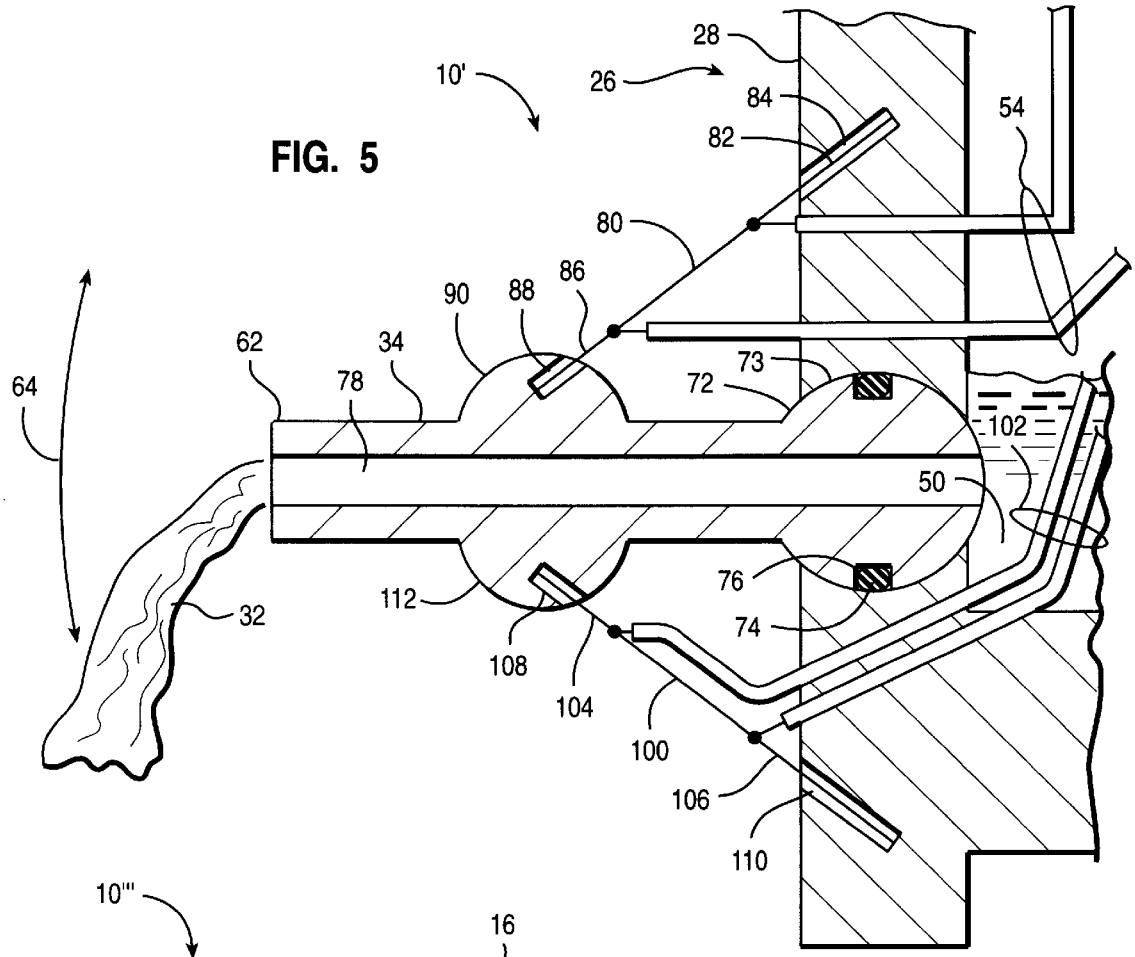
FIG. 5 is a sectional view like FIG. 4 of an alternate exemplary embodiment of the CMP tool in accordance with the present invention.

An alternate exemplary embodiment of the CMP tool, now designated 10', in accordance with the present invention may be understood by referring now to FIG. 5, which is a sectional view like FIG. 4. In this illustrative embodiment, the upward and downward movement of the tube 34 is provided by the above-described shape memory member 80 and a second shape memory member 100 that is positioned below the tube 34 opposite the shape memory member 80. The thermal stimulation of the shape memory member 100 is provided by electrical current supplied by a pair of conductors 102 that may be substantially identical to the conductors 54. The ends 104 and 106 of the shape memory member 100 are positioned in respective bores 108 and 110 in a boss 112 of the tube and in the housing 26. In this illustrative embodiment, the shape memory member 80 may be activated to move the tube 34 downward and, conversely, the shape memory member 100 may be activated to move the tube 34 upward.

Another alternate exemplary embodiment of the CMP tool, now designated 10", in accordance with the present invention may be understood by referring now to FIG. 6, which is a sectional view like FIG. 5. In this illustrative embodiment, fluid 32 is supplied directly to the lumen 78 of the tube 34 by connecting the fluid supply tube 52 shown in FIG. 3 directly to the tube 34 as shown. Here, the internal cavity 50 of the housing 26 is not used to store and/or deliver the semiconductor processing fluid 32 to the lumen 78 of the tube 34. In this way, structures within the cavity 50 are not exposed to the fluid 32 and vice versa, and the pressure of the fluid 32 discharged from the lumen 78 may be carefully tailored to achieve a preselected pattern of fluid dispersal on the polish pad 24.

Figure 7:
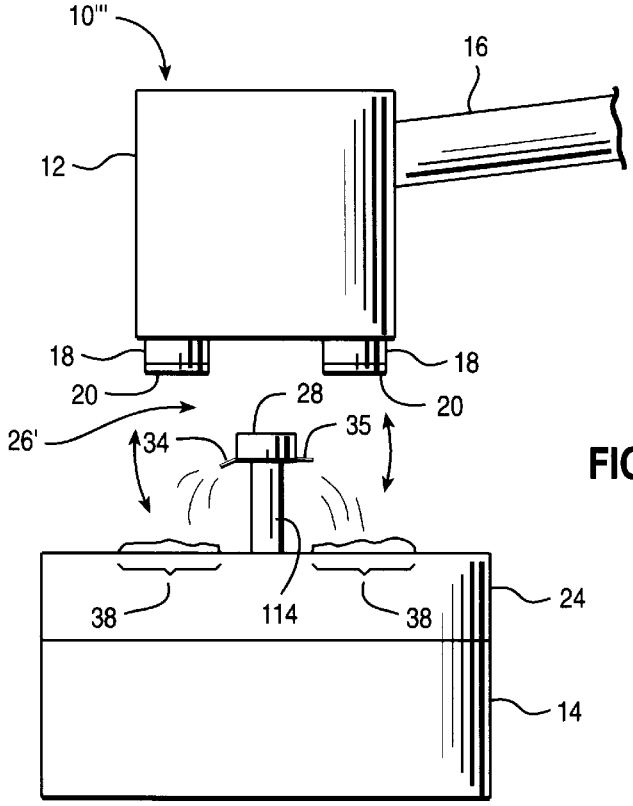
FIG. 7 is a side view like FIG. 1 of an alternate exemplary embodiment of the CMP tool in accordance with the present invention.

Another alternate exemplary embodiment of the CMP tool, now designated 10''', in accordance with the present invention may be understood by referring now to FIG. 7, which is a side view similar to FIG. 1. In this illustrative embodiment, the fluid dispenser, now designated 26', is coupled to the table assembly 14 by way of a shaft 114 that may be a hollow tube like the shaft 30 depicted in FIG. 3. The housing 28 may be configured to remain stationary while the polish pad 24 is rotated or may be connected to and rotate with the polish pad 24 as desired. The dispense tubes 34 and 35 will operate in the manner as generally described above in conjunction with the previously described embodiments.

Another alternate exemplary embodiment of the CMP tool, now designated 10'''', in accordance with the present invention may be understood by referring now to FIG. 8, which is a side view similar to FIG. 1. In this illustrative embodiment, the fluid dispenser, now designated 26", includes a shaft 115 that is mechanically linked to a motor 116 that is positioned in the head assembly 12. The shaft 115 may be hollow like the aforementioned embodiments. The upper end of the shaft 115 is provided with a sprocket 117 that meshes with a cooperating sprocket 118 that is coupled to the motor 116. In this way, the shaft 115 and the housing 28 may be rotated as indicated by the arrow 120 relative to the polish pad 24 so that the fluid 32 may be dispersed on the entirety of the annular surface 38 before the table assembly 14 is activated to rotate the polish pad 24. Furthermore, the shaft 115 and the housing 28 may be rotated while the polish pad 24 is rotated so that fluid may be continually dispensed and evenly dispersed across the polish pad 24 during CMP processing. The respective angular velocities $\omega_1$ and $\omega_2$ of the shaft 115 and the pad 24 may be equal or unequal in both magnitude and direction as desired. Again, the tubes 34 and 35 may operate as describe above.

Another alternate exemplary embodiment of the CMP tool, now designated 10'''', in accordance with the present invention may be understood by referring now to FIG. 9, which is a sectional view like FIG. 5. In this illustrative embodiment, the upward and downward movement of the tube 34 is provided by fabricating the tube 34 with a flex joint 122. The flex joint 122 may be fashioned in the form of a bellows arrangement as shown in FIG. 9 or some other configuration that enables the ready bending movement of the tube 34. As with the aforementioned illustrative embodiments, the upward and downward movement of the tube 34 is provided by one or more shape memory members 80 and 100.

In the embodiment illustrated in FIGS. 1–4, the shape memory members 80 and 81 are depicted as straight lengths of bare wire. However, the shape memory members 80 and 81 may be alternatively coated with a jacket that facilitates the heat transfer from and thus the cooling of the shape memory members 80 and 81 so that their recovery times may be significantly reduced. One such alternate exemplary embodiment may be understood by referring now to FIG. 10, which is a pictorial view of a portion of the shape memory member 80 shown in section with an insulating jacket 124 positioned around the shape memory member 80. The jacket 124 may be composed of PTFE or other like insulating materials. FIG. 11 depicts another alternate exemplary embodiment incorporating a heat sink arrangement for the shape memory member 80. In this illustrative embodiment, the shape memory member 80 is covered by a jacket consisting of a first sheath 126 and a second sheath 128 that has a larger inner diameter than the outer diameter of the first sheath 126 to provide an internal cavity in which a volume of a thermally insulating material such as glycol 128 is disposed.

The skilled artisan will appreciate that the apparatus of the present invention provides for enhanced and selective semiconductor processing fluid dispersal on a CMP pad or other surface. The incorporation of dispensing tubes 34 and 35 with shape memory actuators 80 and 81 permits the selective dispersal of processing fluids on a polish pad surface both before, during and after CMP or other processes. The shape memory members 80 and 81 are simple in design and capable of hundreds of thousands or even millions of cycles. Slurry stagnation at pad edge is avoided since reliance on centrifugal force for horizontal fluid movement is reduced. Slurry refresh during polish may be conducted as needed. Savings may be realized in both prewet time and slurry consumption.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A semiconductor processing fluid dispenser, comprising:

a housing;

a tube coupled to the housing for dispensing a semiconductor processing fluid, the tube having a first end operable to move from a first elevation to a second elevation; and a first shape memory member having a first end coupled to the housing and a second end coupled to the tube, the shape memory member being operable to deform in response to a thermal stimulation to selectively move the tube from the first elevation to the second elevation.

2. The semiconductor processing fluid dispenser of claim 1, wherein the shape memory member comprises a substantially straight rod.

3. The semiconductor processing fluid dispenser of claim 1, wherein the shape memory member comprises a curved rod.

4. The semiconductor processing fluid dispenser of claim 1, wherein the tube has a second end pivotally coupled to the housing.

5. The semiconductor processing fluid dispenser of claim 4, wherein the second end and the housing define a ball and socket joint.

6. The semiconductor processing fluid dispenser of claim 1, wherein the shape memory member comprises a nickel—titanium alloy.

7. The semiconductor processing fluid dispenser of claim 1, wherein the housing comprises a reservoir for the semiconductor processing fluid.

8. The semiconductor processing fluid dispenser of claim 1, comprising a second shape memory member coupled to the tube and the housing for moving the tube from the second elevation to the first elevation.

9. The semiconductor processing fluid dispenser of claim 1, comprising a biasing member to bias the first end toward the first elevation.

10. The semiconductor processing fluid dispenser of claim 1, wherein the fluid comprises a CMP slurry.

11. The semiconductor processing fluid dispenser of claim 1, comprising means for thermally stimulating the first shape memory member.

12. The semiconductor processing fluid dispenser of claim 11, wherein the means for thermally stimulating the first shape memory member comprises a first conductor and a second conductor coupled to the first shape memory member to flow electric current through the first shape memory member.

13. The semiconductor processing fluid dispenser of claim 1, wherein the first shape memory member comprises a thermally insulating jacket.

14. The semiconductor processing fluid dispenser of claim 13, wherein the thermally insulating jacket comprises a first sleeve positioned around the first shape memory member, a second sleeve positioned around the first sleeve and a volume of liquid contained between the first and second sleeves.

15. A CMP tool, comprising:

a polish pad for polishing a workpiece;

a head assembly for holding the workpiece during polishing; and a fluid dispenser for dispensing a fluid to process the workpiece, the fluid dispenser having a housing, a tube coupled to the housing for dispensing a semiconductor processing fluid, the tube having a first end operable to move from a first elevation to a second elevation; and a first shape memory member having a first end coupled to the housing and a second end coupled to the tube, the shape memory member being operable to deform in response to a thermal stimulation to selectively move the tube from the first elevation to the second elevation.

16. The CMP tool of claim 15, wherein the shape memory member comprises a substantially straight rod.

17. The CMP tool of claim 15, wherein the shape memory member comprises a curved rod.

18. The CMP tool of claim 15, wherein the tube has a second end pivotally coupled to the housing.

19. The CMP tool of claim 18, wherein the second end and the housing define a ball and socket joint.

20. The CMP tool of claim 15, wherein the shape memory member comprises a nickel—titanium alloy.

21. The CMP tool of claim 15, wherein the housing comprises a reservoir for the semiconductor processing fluid.

22. The CMP tool of claim 15, comprising a second shape memory member coupled to the tube and the housing for moving the tube from the second elevation to the first elevation.

23. The CMP tool of claim 15, comprising a biasing member to bias the first end toward the first elevation.

24. The CMP tool of claim 15, wherein the fluid comprises a CMP slurry.

25. The CMP tool of claim 15, comprising means for thermally stimulating the first shape memory member.

26. The CMP tool of claim 25, wherein the means for thermally stimulating the first shape memory member comprises a first conductor and a second conductor coupled to the first shape memory member to flow electric current through the first shape memory member.

27. The CMP tool of claim 15, wherein the first shape memory member comprises a thermally insulating jacket.

28. The CMP tool of claim 27, wherein the thermally insulating jacket comprises a first sleeve positioned around the first shape memory member, a second sleeve positioned around the first sleeve and a volume of liquid contained between the first and second sleeves.

29. A CMP tool, comprising:

a polish pad for polishing a workpiece;

a head assembly for holding the workpiece during polishing; and a fluid dispenser for dispensing a fluid to process the workpiece, the fluid dispenser having a housing, a tube coupled to the housing for dispensing a semiconductor processing fluid, the tube having a first end and a second end pivotally coupled to the housing so that the first end is operable to move from a first elevation to a second elevation; and a first shape memory member having a first end coupled to the housing and a second end coupled to the tube, the shape memory member being operable to deform in response to a thermal stimulation to selectively move the first end of the tube from the first elevation to the second elevation; and means for thermally stimulating the first shape memory member; and a biasing member to bias the first end of the tube toward the first elevation.

30. The CMP tool of claim 29, wherein the first shape memory member comprises a substantially straight rod.

31. The CMP tool of claim 29, wherein the first shape memory member comprises a curved rod.

32. The CMP tool of claim 29, wherein the second end of the tube and the housing define a ball and socket joint.

33. The CMP tool of claim 29, wherein the first shape memory member comprises a nickel-titanium alloy.

34. The CMP tool of claim 29, wherein the housing comprises a reservoir for the semiconductor processing fluid.

35. The CMP tool of claim 29, wherein the biasing member comprises a second shape memory member coupled to the tube and the housing for moving the tube from the second elevation to the first elevation.

36. The CMP tool of claim 29, wherein the fluid comprises a CMP slurry.

37. The CMP tool of claim 36, wherein the means for thermally stimulating the first shape memory member comprises a first conductor and a second conductor coupled to the first shape memory member to flow electric current through the first shape memory member.

38. The CMP tool of claim 29, wherein the first shape memory member comprises a thermally insulating jacket.

39. The CMP tool of claim 38, wherein the thermally insulating jacket comprises a first sleeve positioned around the first shape memory member, a second sleeve positioned around the first sleeve and a volume of liquid contained between the first and second sleeves.

* * * * *